US006390712B1

(12) United States Patent
Urness

(10) Patent No.: US 6,390,712 B1
(45) Date of Patent: May 21, 2002

(54) AIRTIMER PLANNING SYSTEM

(76) Inventor: Daniel L. Urness, 1217 N. Marvin St., Gilbert, AZ (US) 85233

( * ) Notice: Subject to any disclaimer, the term of this patent is extended or adjusted under 35 U.S.C. 154(b) by 0 days.

(21) Appl. No.: 09/449,390

(22) Filed: Nov. 26, 1999

Related U.S. Application Data

(60) Provisional application No. 60/110,140, filed on Nov. 30, 1998.

(51) Int. Cl.[7] ..... B42D 1/00

(52) U.S. Cl. ..... 402/4; 402/73; 402/70; 281/29; 281/37

(58) Field of Search ..... 402/4, 73, 70; 281/29, 31, 36, 37, 21.1, 15.1, 28; 455/92; 224/413

(56) References Cited

U.S. PATENT DOCUMENTS 5,232,301 A * 8/1993 Bianco ..... 402/73
5,347,693 A 9/1994 Otrusina ..... 24/597
5,348,347 A * 9/1994 Shink ..... 281/31
5,375,883 A * 12/1994 Wyant ..... 402/4 X
5,897,040 A 4/1999 Ward ..... 224/413
6,017,062 A * 1/2000 White ..... 281/29
6,059,478 A * 5/2000 Moor ..... 281/29 X
6,081,695 A 6/2000 Wallace et al. ..... 455/90

* cited by examiner

*Primary Examiner*—Willmon Fridie, Jr.
(74) *Attorney, Agent, or Firm*—L. E. Carnahan

(57) ABSTRACT

A planning system which provides individuals the ability to combine the time saving advantages of mobil phones and personal planning systems. The planning system (Airtimer) incorporates a mobil phone to compliment the planning and execution of goals, tasks and activities in a convenient manner. The Airtimer includes a phone mounting system to provide simple, convenient access to a mobil phone at all times. The Airtimer also includes a metal ring binder for daily planner sheets, a loose paper pocket, a checkbook pocket, credit/business card pockets and pen/pencil holders. The Airtimer, when closed, may be secured by a zipper while allowing plug-in access to the mobil phone for recharging purposes, and is composed of an outer sheet for durability and a thinner inner sheet which provides the basic form of the planner. Both the inner and outer sheets are covered with material such as leather, cloth, vinyl, etc., and the zipper extends around the perimeter of the sheets for securing the planner with the mobil phone retained therein.

16 Claims, 1 Drawing Sheet

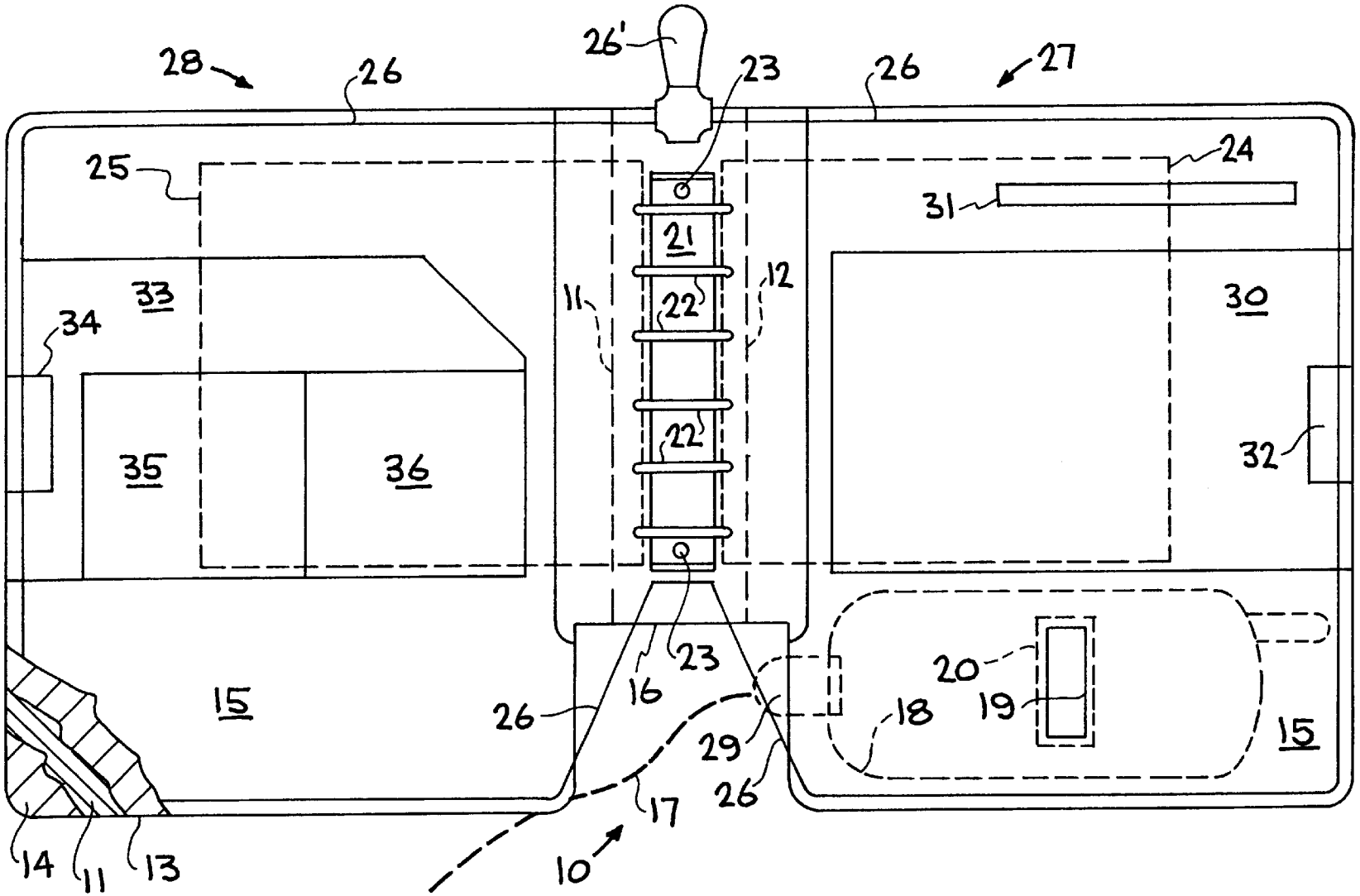
27
26
23
26'
28
26
25
24
31
30
32
33
34
35
36
12
11
21
22
22
23
16
26
29
26
17
10
15
20
19
18
15
13
11
14

AIRTIMER PLANNING SYSTEM

RELATED APPLICATION

This application relates to U.S. Provisional Application No. 60/110,140 filed Nov. 30, 1998, and claims priority thereof.

BACKGROUND OF THE INVENTION

The present invention relates to personal planners, particularly to a daily planner which combines the advantages of a mobil phone with a personal planner, and more particularly to a daily planning system which incorporates mobil communications and an organizer enclosed in a zipper-secured folder.

Personal day planners/organizers are now a common tool for people from all walks of life. Similarly, mobil phones and mobil communication systems, including pagers, are now widely used. Like personal daily planner/organizers, the mobil communication equipment offers a continually expanding group of users the time saving advantages. However, in addition to a planner, mobil phone and pager, for example, many individuals carry numerous other accessories such as sunglasses, keys, wallets, purses and books, as well as credit or business cards and checkbooks. In addition, carrying of mobil phones can be awkward or inconvenient to carry in certain situations since such are generally carried in a hand, a pocket or clipped to a belt or pocket, for example.

The present invention provides a solution to the mobil phone/personal planner carrying problem, providing a planning system which gives individuals the ability to combine the time saving advantages of mobil phones and personal daily planners. The planning system of this invention, referred to hereinafter as "Airtimer", incorporates a mobil phone to compliment the planning and execution of goals, tasks and activities in a convenient manner. The phone mounting system provides simple, convenient access to a mobil phone at all times and safely secures the phone, using the mounting clip of existing phone cases, while allowing access to the phone for recharging purposes. The Airtimer also includes a daily planner section, a telephone directory, a compartment for loose papers, credit/business card and check book compartments as well as pen and pencil holders. The Airtimer is enclosed in a zipper-secured binder which includes a phone recharge cable access.

SUMMARY OF THE INVENTION

It is an object of the present invention to provide a system which incorporates a daily planner with mobil communication.

A further object of the invention is to provide a planning system that enables individuals to combine the advantages of mobil communication with personal planning.

Another object of the invention is to provide a binder in which are incorporated a daily planner, a mobil phone, telephone directory and other items utilized by individuals to carry out planned goals and tasks.

Another object of the invention is to provide a zipper-secured binder which includes planning forms and other items in combination with an accessible mobil phone but which, in its closed position, enables access to the phone for recharging thereof.

Other objects and advantages of the invention will become apparent from the following description and accompanying drawing. The present invention is a planning system which incorporates into a single binder a daily planner/organizer and a mobil communication system. The planning system of this invention referred to herein as "Airtimer" comprises a binder which readily accommodates storage of most mobil phones and includes a phone mounting system which provides simple, convenient storage and access to a mobil phone at all times, and uses a mounting clip generally found on existing phone cases and which is not visible from the outside of the binder. The binder is secured by a zipper which allows a phone to be charged while it remains safely in the near zipped-up position. The Airtimer, in addition to a ring binder and mobil phone, includes credit/business card pouches, a loose item flap, pen and pencil holders, a checkbook pouch, a telephone directory and other items. The Airtimer is basically composed of a shell having inner and outer sheets of a cardboard-like material known as chipboard, the inner sheet being thinner than the outer sheets, with the inner sheet providing the basic form of the planner and the outer sheets providing durability. The inner and outer sheets are covered with material such as leather, vinyl or other appropriate fabric, then stitched together. The mobil phone mounting clip is inserted into a reinforced opening in the inner sheet and a small daily planner ring binder is secured, as by rivets, to the inner sheet. A zipper is secured about the perimeter of the covered outer sheets and is attached so as to enable recharge access to the phone while enclosed within the Airtimer.

BRIEF DESCRIPTION OF THE DRAWINGS

The accompanying drawing, which is incorporated into and forms a part of the disclosure, illustrates an embodiment of the invention and, together with the description, serves to explain the principles of the invention.

The single FIGURE illustrates an embodiment of the planning system of the invention showing the composition of the binder, the is various features located therein and the zipper closure thereof.

DETAILED DESCRIPTION OF THE INVENTION

The present invention is a planning system mounted in a zipper-enclosed binder and referred to herein as "Airtimer".

The Airtimer is a personal day planner/organizer which readily accommodates storage of most mobil phones. The Airtimer is therefore unique from other planners in concept and includes a number of distinct features peculiar to this product.

The Airtimer has a unique phone mounting system created to provide simple, convenient access to a mobil phone at all times while reducing the thickness of the Airtimer to the minimum necessary for most mobil phones. The mounting system safely secures a phone using the mounting clips found on existing leather phone cases. These cases are readily available and custom made for virtually every model of mobil phone today. This mounting system is invisible from the outside of the planner. The phone clip inserts into a rectangular hole cut out of the inner panel and the two outer panels comprise the back and front covers of the planner.

The unique Airtimer zipper design allows a phone to be charged while it remains safely in the Airtimer after it has been nearly zipped up. In addition, the Airtimer includes credit and business card pouches, a loose item flap, pen and pencil holders, and a checkbook sized pouch which facilitates simple use of a checkbook and other items. These features are all above the phone compartment, further streamlining the Airtimer.

In addition to a small daily planner binder mounted in the Airtimer, the paper insert package includes a phone directory with a speed-dial section for effective use of a mobil phone's capability to store numerous phone numbers. The daily planner binder gives priority to mobil communication on a daily basis with a section devoted to planning and executing calls. The Airtimer utilizes a date specific daily planning format. This format provides an effective planning environment and optimizes "white space" to avoid excess clutter and allow for enhanced individual preference and style.

The Airtimer may be manufactured with a leather or vinyl exterior, although other materials may be used as well. The Airtimer empowers individuals to incorporate the flexibility, efficiency and effectiveness of wireless communication in the personal planning process.

The Airtimer is basically composed of three sheets of cardboard like material which makes up the shell of a binder, covered with a material such as leather, provided with a small ring binder, slots or holders for insertion of various articles, and a reinforced opening for retaining a mobil phone, all enclosed by a zipper secured about the perimeter of the binder.

Referring now to the single figure, the Airtimer is illustrated in its open position illustrating a small ring binder, slots for various papers and/or cards, pen or pencil holders, a reinforced slot for phone clip retention and an enclosing zipper arrangement, and which is constructed to enable recharge access to a mobil phone therein with the Airtimer in a closed position and the zipper in a near zipped-up condition. As seen in the FIGURE, the Airtimer, generally indicated at 10, is basically constructed of a pair of outer sheets or pieces of chipboard 11 and 12 and an inner chipboard 13, the sheets being of a cardboard like material which is standard in the industry, and with the outer sheets 11 and 12 having, for example, a thickness of about ⅛ inch. Only a section of sheet 11 is shown but the inner edges are indicated by dashed lines. The inner sheet 13 has a thickness of about 1/16 inch, with only a section thereof being shown. Outer sheets 11 and 12 are covered with a material 14 (only a section shown) which may be leather, vinyl or fabric, and inner sheet 13 is covered with a material 15 which may be the same as or different from the outer material 14. The materials 14 and 15 are glued, cemented, stitched or otherwise secured to at least the edges of the sheets 11–12 and 13, and the material may be overlapped and be bonded to an opposite side of the respective sheets (as well known in the art). The inner sheet 13 is secured to outer sheets 11 and 12 about the perimeters thereof (as common place in the covered binder art). Since the covering and securing of the covering materials 14 and 15 to respective sheets 11–12 and 13, and binding of the sheets and covering material to form a covered binder or planner is well known, further details are deemed unnecessary.

Sheets 11–12 and 13 and materials 14 and 15 include a cutaway or notch section 16 which enables insertion of a phone charging cord indicated at 17 to be attached to a mobil phone (not shown but positioned on material 15 and inner sheet 13 as indicated by the dashed phone area outline 18). The conventional clip of a mobil phone is inserted into slot 19 in material 15 and inner sheet 13. The slot 19 is reinforced, as indicated at 20 by a plastic edge member or piece or other conventionally known reinforcement means located beneath the material 15. If desired, the reinforcement edge piece can be located external of the material 15 to prevent the material from being damaged by repeated insertion and removal of the phone clip into the slot 19 which, for example, may be 2 inches by 1½ inches. Note that when a phone clip is inserted into slot 19, it is located intermediate outer sheet 12 and inner sheet 13 and thus is not visible from the outer sheet side of the Airtimer.

A ring binder 21 having rings 22, such as a metal six ring binder, is mounted on material 15 and secured to inner sheet 13 as by rivets 23 or other conventional securing means. Ring binder 21 retains daily planner pages which, for example, may be opened and spread as a right page 24 and a left page 25. The binder 21 may be constructed to only have 2, 3 or other numbers of rings 22, and the circumference of the rings may define a height so as to be about the same as the thickness of a mobil phone mounted in area 18. A zipper 26 having a finger tab or actuator 26' located adjacent one end of ring binder 21 is secured to edges of the right and left side of sections indicated at 27 and 28 of Airtimer 10 and terminates adjacent an opposite end of ring binder 21. Note that the zipper 26 extends through the cutaway 16 such that when left side or section 28 is folded onto right side or section 27 of Airtimer 10, the zipper 26 may be left partially unzipped at the area of cutaway 16 to enable insertion of the charging cord 17 into the mobil phone 18, with the phone secured within Airtimer 10. The zipper 26 is secured to the edges of sections 27 and 28 as by stitching or bonding, etc. (as known in the art). The zipper 26 may be replaced by other types of binder securing or connector means, such as members which snap together, etc.

By way of example, with the side or section 28 folded about ring binder 21 and onto side or section 27, the Airtimer 10 has a width of 8½ inches, length or height of 9½ inches and thickness of 2½ inches. The pages 24–25, for example, are 6 inches wide and 5¼ tall. A mobil phone mounted in area 18, for example, including the antenna area and a phone case with clip, is 2½ inches in width, 7 inches in length, and 1⅞ inches thick. As shown, with a mobil phone mounted in the Airtimer via the slot 19, a plug section 29 of recharger cord 17 can be inserted into an end of a phone positioned in area 18 for recharging the mobil phone.

Airtimer 10, in addition to the mobil phone area 18 and the ring binder 21 with pages 24 and 25, is also provided, for example, with a checkbook pouch 30, a telephone directory or tablet retaining slot 31, and a pen or pencil holder 32 on the right side or section 27, with the left side or section 28 being provided with a loose paper flap 33, a pen or pencil holder 34, and a pair of credit/business card pockets 35 and 36. By way of example, the checkbook pouch 30, which may be composed of material like material 15, is stitched to both the material 15 and the inner sheet 13 along the sides and lower end, leaving the upper end open. The slot 31 may be formed in both the material 15 and inner sheet 13, or only in the material 15, which is of sufficient strength for a backing member of a telephone directory or tablet. Reinforcement (not shown) is provided about the edges of slot 31. Holder 32 comprises a loop of material similar to material 15, for example, which is stitched to material 15 and inner sheet 13. Loose paper flap 33, which may be composed of material like material 15, is stitched to material 15 and inner sheet 13 along the lower end and the side adjacent pen holder 34, but may also be stitched along the side adjacent ring binder 21. Pen or pencil holder 34, which comprises a loop of material that may be the same as material 15, is stitched to material 15 and inner sheet 13. Card pockets 35 and 36, which also may be composed of the same material as material 15, may, for example, be formed of a single piece of material stitched to the material of loose card flap 33 along the center, edges and lower areas to form the two pockets whereby the cards are inserted via the upper open areas. While Airtimer 10 has been illustrated with various relating means such as slots, flaps, pockets, etc. on the interior of sides or sections 27 and 28, other retaining means may be provided in addition to or in place of those illustrated in the drawing.

It has thus been shown that the present invention provides a daily planner which accommodates a mobil phone within the planner. The planner is provided with a phone mounting arrangement which utilizes the conventional phone clip. The planner is constructed and secured by a zipper arrangement which enables a phone recharge cord to be attached to the phone while secured within the planner. Also, the planner is arranged to enable devoting one section to a phone directory insert to provide ready access as well as replacement pages for daily planning. In addition, the planner is designed to include various pockets, pouches, flaps and holders for items normally needed during daytime use. The planner, with a mobil phone removably mounted therein, in its closed position is relatively small (8½×9½×2¼ inches), thus enabling it to be easily carried while providing ready access to the mobil phone removably mounted therein. The Airtimer is constructed such that the binder rings, pages and pockets sit high (in the upper section) to accommodate the mobil phone in the bottom section. The mobil phone mount, a rectangular slot in the binder panel, allows a clip from a typical mobil phone case to secure the phone to the planner, with the mounted phone being invisible from outside the planner. The planner includes a cutaway or notch in the central lower portion which allows recharge cord access to the mobil phone when the planner is closed and almost completely zipped shut.

While a particular embodiment of the invention has been illustrated and described, along with materials and parameters to exemplify and teach the principles of the invention, such are not intended to be limiting. Modifications and changes may become apparent to those skilled in the art, and it is intended that the invention be limited only by the scope of the appended claims.

What is claimed is:

1. A combination comprising:

a planner consisting of a pair of foldable sections, one of said pair of foldable sections having a slot in an inner side surface, and a hand held electronic device having a clip removably mounted in said slot in said inner side surface of said one of said pair of foldable sections of said planner for removably mounting said electronic device in said slot in said planner.

2. The combination of claim 1, wherein said pair of foldable sections of said planner are removably secured together by a securing arrangement.

3. The combination of claim 2, wherein said securing arrangement comprises a zipper.

4. The combination of claim 1, wherein said pair of foldable sections include a cutaway section located adjacent an end of said electronic device to enable connection of a recharge cord to said electronic device while said foldable sections are at least partially secured together.

5. The combination of claim 1, wherein said pair of foldable sections each include an outer sheet of material of a first thickness and are each attached to an inner sheet of material of a lesser thickness.

6. The combination of claim 5, wherein said pair of foldable sections additionally include at least one material covering each of said outer sheets and said inner sheets.

7. The combination of claim 6, wherein said pair of foldable sections are provided with a zipper around the perimeter thereof to secure said foldable members together.

8. The combination of claim 1, wherein said pair of foldable sections are provided with means located adjacent said inner sheet and selected from one or more of the group consisting of a ring binder, pockets, pouch, flap, holders and slots for retaining various items.

9. The combination of claim 1, wherein said pair of foldable sections are foldable about a centrally located ring binder, and a zipper mounted to said foldable sections to secure said foldable sections to secure said foldable sections together, and wherein said hand held electronic device comprises a mobil phone located intermediate said foldable sections and mounted via said slot.

10. In a planner consisting of a pair of foldable side sections and means for removably securing said pair of foldable side sections together, the improvement comprising:

means for mounting a mobil phone to an inner surfacer of one of said pair of foldable side sections such that an associated mobil phone, when mounted therein, is located intermediate said pair of foldable side sections when said removably securing means secures same together, said means for mounting a mobil phone consisting of a slot formed in said inner surface of said one of said pair of foldable side sections, and said mobil phone including a clip removably mounted in said slot.

11. The improvement of claim 10, additionally including providing a cutaway in said foldable side sections to enable connecting an associated recharge cord to an associated mobil phone when such an associated mobil phone is secured intermediate said foldable side sections.

12. The planner of claim 10, wherein said means for removably securing said foldable side sections comprise a zipper.

13. The planner of claim 10, additionally including means for retaining various items intermediate said foldable side sections when secured together.

14. The planner of claim 13, wherein said means for retaining various items includes at least a ring binder for retaining daily planner pages.

15. A planner having at least a hand held electronic device removably mounted therein, consisting of:

a pair of foldable side sections removably secured together by a securing arrangement, said pair of foldable side sections each having means on an interior surface for retaining various items intermediate said foldable side sections when secured together, one of said means consisting of a slot constructed to removably retain said hand held electronic device, said hand held electronic device including a clip for removably retaining said hand held electronic device in said slot.

16. The planner of claim 15, wherein said hand held electronic device comprises a mobil phone.

* * * * *